US006945864B2

(12) United States Patent
Hino et al.

(10) Patent No.: US 6,945,864 B2
(45) Date of Patent: Sep. 20, 2005

(54) COIN SORTING APPARATUS

(75) Inventors: Yushi Hino, Himeji (JP); Masaharu Tochio, Himeji (JP); Daisuke Hoshino, Himeji (JP)

(73) Assignee: Glory Kogyo Kabushiki Kaisha, Hyogo-ken (JP)

( * ) Notice: Subject to any disclaimer, the term of this patent is extended or adjusted under 35 U.S.C. 154(b) by 235 days.

(21) Appl. No.: 10/329,400

(22) Filed: Dec. 27, 2002

(65) Prior Publication Data

US 2003/0124966 A1 Jul. 3, 2003

(30) Foreign Application Priority Data

Dec. 27, 2001 (JP) ..... 2001-397502

(51) Int. Cl.[7] ..... G07D 3/00
(52) U.S. Cl. ..... 453/14; 453/3
(58) Field of Search ..... 453/14, 3, 6, 10, 453/12, 13, 49, 57, 63

(56) References Cited

U.S. PATENT DOCUMENTS 4,474,197 A 10/1984 Kinoshita et al. ..... 133/4 A
5,022,889 A * 6/1991 Ristvedt et al. ..... 453/6
5,372,542 A 12/1994 Geib et al. ..... 453/10
5,453,047 A 9/1995 Mazur et al. ..... 453/10
5,782,686 A * 7/1998 Geib et al. ..... 453/10
6,080,057 A 6/2000 Bell et al. ..... 453/57

FOREIGN PATENT DOCUMENTS

GB 2.224.151 A * 4/1990 ..... G07D/3/00
WO 99/48058 9/1999 ..... G07D/3/06

* cited by examiner

*Primary Examiner*—Donald P. Walsh
*Assistant Examiner*—Mark J Beauchaine
(74) *Attorney, Agent, or Firm*—Wenderoth, Lind & Ponack, L.L.P.

(57) ABSTRACT

The present invention relates to a coin sorting apparatus comprising a stationary member, and a rotary disk supported for rotation and disposal under the stationary member contiguously with a lower surface of the stationary member. The coin sorting apparatus is constructed such that coins slide along the lower surface of the stationary member as the rotary disk rotates, and such that these sliding coins are guided into a coin passage. The apparatus is adapted to receive coins including a deformed coin bent such that a convex side thereof faces the lower surface of the stationary member. The coin passage has a recessed-profile configured to accommodate the convex side of the deformed coin to ensure engagement of an outer edge of the deformed coin with a radial inner edge portion of the coin passage.

12 Claims, 10 Drawing Sheets

COIN SORTING APPARATUS

BACKGROUND OF THE INVENTION

1. Field of the Invention

The present invention relates to a coin sorting apparatus comprising a stationary member and a rotary disk disposed under the stationary member contiguously with a lower surface thereof. The coin sorting apparatus is constructed such that coins sliding along the lower surface of the stationary member are sorted according to diameters thereof as the rotary disk rotates.

2. Description of the Related Art

FIG. 13 shows a coin sorting apparatus disclosed in the applicant's Japanese patent application No. 2001-79206 filed on Mar. 19, 2001. In FIG. 13, the coin sorting apparatus comprises a stationary disk (stationary member) 101 and a rotary disk 2 disposed under the stationary disk 101 contiguously with a lower surface thereof. The rotary disk 2 comprises a disk body 22 supported for rotation about a shaft 20, and a resilient member 24 attached to an upper surface of the disk body 22.

An inlet opening 1*a* is formed in a central part of the stationary disk 101. The coin sorting apparatus is formed such that a coin fed through the inlet opening 1*a* of the stationary disk 101 slides along lower surface 1*b* (FIG. 14) of the stationary disk 101 as the rotary disk 2 rotates. A guide structure is formed in the stationary disk 101 for selectively guiding coins sliding along the lower surface 1*b* of the stationary disk 101, according to diameters of the coins.

As shown in FIG. 14, the guide structure comprises a coin passage 110 formed concavely in the lower surface 1*b* of the stationary disk 101. The coin passage 110 extends counterclockwise as viewed in FIG. 14 in a meandering spiral from the inlet opening 1*a* toward a periphery of the stationary disk 101. The coin passage 110 has, arranged from the inlet opening 1*a* toward the periphery of the stationary disk 101, a large-coin passage section 110*a*, a medium-coin passage section 110*b* and a small-coin passage section 110*c*. The large-coin passage section 110*a* has a width that permits passage of large, medium and small coins. The medium-coin passage section 110*b* has a width L1 that permits passage of only medium and small coins. The small-coin passage section 110*c* has a width L2 that permits passage of only small coins.

The large-coin passage section 110*a* has a coin entrance 11 facing the inlet opening 1*a*, and stairs 112*a* and 112*b* formed at an interval on a downstream side with respect to the coin entrance 11. The stairs 112*a* and 112*b* are formed to reduce a thickness of a gap between the resilient member 24 of the rotary disk 2 (FIG. 13) and the large-coin passage section 110*a* stepwise toward a downstream side thereof. By virtue of the stairs 112*a* and 112*b*, overlapping coins are separated from each other to ensure that coins do not overlap each other and move in a single file in the coin passage 110.

A coin returning part 113 is formed contiguously with the inlet opening 1*a* on a downstream side with respect to the stairs 112*a* and 112*b*. There is a possibility that a pair of overlapping coins pass the stairs 112*a* and 112*b* without being separated from each other. These overlapping coins include an "upper coin" that is contiguous with the stationary disk 101 and a "lower coin" that is contiguous with the rotary disk 2. Thus, the coin returning part 113 is configured to return the "lower coin" toward the inlet opening 1*a*.

Since the large-coin passage section 110*a* extends spirally away from the center toward a circumference of the stationary disk 101, it is intended that outer edges of all the coins moving therein should engage a radial inner edge portion 110*i-a* thereof.

A large-coin sorting guide 115*a* is disposed radially outside the medium-coin passage section 110*b* to guide only large coins selectively and to eject the large coins in a substantially tangential direction. The large-coin sorting guide 115*a* has a step 116*a* and an ejecting passage 117*a*. The step 116*a* is formed at a boundary between the large-coin passage section 110*a* and the medium-coin passage section 110*b*. The step 116*a* is formed such that only a peripheral part of each of the large coins of diameters greater than the width L1 of the medium-coin passage section 110*b* runs onto the step 116*a*.

The ejecting passage 117*a* has a guide edge 118*a* for guiding a coin that has run onto the step 116*a* for movement in a substantially tangential direction, and an outlet 119*a* through which the coin guided by the guide edge 118*a* is ejected to an exterior. Since all the coins engage the radial inner edge portion 110*i-a*, medium coins and small coins respectively having diameters smaller than the width L1 do not run onto the step 116*a* and move into the medium-coin passage section 110*b*.

A medium-coin sorting guide 115*b* is disposed radially outside the small-coin passage section 110*c* to guide only medium coins selectively, and to eject the medium coins in a substantially tangential direction. The medium-coin sorting guide 115*b*, similarly to the large-coin sorting guide 115*a*, has a step 116*b* and an ejecting passage 117*b*.

The step 116*b* is formed at a boundary between the medium-coin passage section 110*b* and the small-coin passage section 110*c*. The step 116*b* is formed such that only a peripheral part of each of the medium coins of diameters greater than the width L2 of the small-coin passage section 110*c* runs onto the step 116*b*. The step 116*b* is formed by an adjustable step plate S2'. The ejecting passage 117*b*, similarly to the ejecting passage 117*a* of the large-coin sorting guide 115*a*, has a guide edge 118*b* and an outlet 119*b*.

Since a downstream part of the medium-coin passage section 110*b* extends away from the center toward the outer circumference of the stationary disk 101, it is intended that outer edges of all the coins moving therein should engage a radial inner edge portion 110*i-b* thereof. Thus, small coins of a diameter smaller than the width L2 move into the small-coin passage section 110*c* without running onto the step 116*b*.

The small-coin passage section 110*c* extends downstream toward an inner circumference and then toward the outer circumference of the stationary disk 101, and terminates in a small-coin sorting guide 115*c* having an outlet 119*c*.

Foreign matter sorting structure 108 is arranged on the stationary disk 101. The foreign matter sorting structure 108 has a foreign matter passage 180 branched off from the small-coin passage section 110*c*, and a stepped gate 182 formed at a junction of the small-coin passage section 110*c* and the foreign matter passage 180. The foreign matter sorting structure 108 selectively ejects foreign matter, such as paper clips, thinner than a thinnest coin.

This coin sorting apparatus has the following problems. The radial inner edge portion 110*i-a* (110*i-b*), which is configured to engage the outer edges of all the coins, defines a shoulder formed of a height less than a thickness of a thinnest coin so as not to prevent the "lower coin" from returning, e.g. through the coin returning part 113, toward the inlet opening 1*a*. On the other hand, as shown in FIG. 15, there is a possibility that coins to be sorted include a deformed coin C', bent such that a convex side thereof faces the lower surface 1*b* of the stationary disk 101. If the deformed coin C' is fed into the coin passage 110 with its bending axis in a substantially tangential direction with respect to the coin passage 110, there is a possibility that an outer edge of the deformed coin C' does not engage the radial inner edge portion 110*i-a* (110*i-b*). In this case, the coin sorting apparatus is likely to fail in performing an intended coin sorting operation and cause a miss-sorting and/or a hold-up of coins therein.

In addition, considering a case of a coin jam between the stationary disk 101 and the rotary disk 2, it is advantageous if a sorting process can be continued by rotating the rotary disk 2 in reverse temporarily, and then continuing to rotate the rotary disk 2 forwardly in normal operation. However, in the above coin sorting apparatus, the guide edges 118*a* and 118*b* of the ejecting passages 117*a* and 117*b* include stepped portions 118*a'* and 118*b'*. The stepped portions 118*a'* and 118*b'* define vertical walls formed transversely of coin-passing directions between the steps 116*a* and 116*b* and the ejecting passages 117*a* and 117*b*, respectively.

Therefore, once coins have passed into the ejecting passage 117*a* and 117*b* through the stepped portions 118*a'* and 118*b'*, these coins cannot return to an upstream side with respect to the stepped portions 118*a'* and 118*b* even if the rotary disk is reversely rotated. In this case, when the rotary disk 2 is rotated forwardly again, the coin sorting apparatus is likely to cause the miss-sorting and/or the hold-up of the coins therein, and fail to resume a normal coin sorting operation.

SUMMARY OF THE INVENTION

Accordingly, it is an object of the present invention to provide a coin sorting apparatus capable of ensuring an engagement of an outer edge of a deformed coin with a radial inner edge portion of a coin passage so as to always perform a normal coin sorting operation.

Another object of the present invention is to provide a coin sorting apparatus capable of allowing coins that have passed into an ejecting passage through a stepped portion to return to an upstream side with respect to the stepped portion when a rotary disk is reversely rotated so as to resume a normal coin sorting operation when the rotary disk is rotated forwardly again.

According to the present invention, there is provided a coin sorting apparatus comprising: (a) a stationary member provided with a central coin-feed opening: and (b) a rotary disk supported for rotation and disposed under the stationary member contiguously with a lower surface of the stationary member. The coin sorting apparatus is constructed such that coins fed into the coin-feed opening of the stationary member slide along the lower surface of the stationary member as the rotary disk rotates. The stationary member is provided with a guide structure for selectively guiding coins sliding along the lower surface thereof, according to diameters of the coins. The guide structure has: (1) a coin passage formed in the lower surface of the stationary member and having a radial inner edge portion configured to engage outer edges of all the coins to be guided, with the radial inner edge portion defining a shoulder formed of a height smaller than a thickness of a thinnest coin; and (2) a coin-sorting guide disposed radially outside the coin passage. The coin-sorting guide has: (2a) a step formed such that a peripheral part of each of coins having diameters greater than a reference diameter run up onto the step with the outer edge thereof engaging the radial inner edge portion of the coin passage, and (2b) an ejecting passage for guiding the coin that has run up onto the step and ejecting this same coin exteriorly of the stationary member. The coin sorting apparatus is adapted to receive coins including a deformed coin bent such that a convex side thereof faces the lower surface of the stationary member. The coin passage has, at least in a section corresponding to the radial inner edge portion thereof, a recessed-profile configured to accommodate the convex side of the deformed coin to ensure engagement of an outer edge of the deformed coin with the radial inner edge portion.

Thus, it is possible to ensure engagement of the outer edge of the deformed coin with the radial inner edge portion of the coin passage having the recessed-profile. Accordingly, even if coins to be sorted include the deformed coin, it is possible to always perform a normal coin sorting operation.

In the coin sorting apparatus, the recessed-profile of the coin passage may include a stepped-profile configured to prop a peripheral part of each of the coins to be guided, on a radial outer side of the coin passage.

In the coin sorting apparatus, the recessed-profile of the coin passage preferably includes a plurality of stepped-profiles corresponding to a plurality of ranges of diameters of coins.

Thus, it is possible to form the recessed-profile having an optimum configuration for each of the ranges of the diameters of the coins.

In the coin sorting apparatus, the coin-sorting guide may further have a stepped portion formed transversely of a coin-passing direction between the step and the ejecting passage. In this case, the stepped portion preferably has a sloped configuration.

Thus, it is possible to allow coins that have passed into the ejecting passage through the stepped portion to smoothly return to a side opposite the ejecting passage when the rotary disk is reversely rotated. Accordingly, it is possible to resume a normal coin sorting operation when the rotary disk is rotated forwardly again. In addition, it is possible to ensure a reliability of a batch stopping operation, i.e. an operation in which a coin sorting operation is suspended and resumed by stopping rotation of the rotary disk and rotating the rotary disk forwardly as occasion demands.

In the coin sorting apparatus, preferably, the stationary member is further provided with a return guide configured to guide coins to return the same toward the coin-feed opening when the rotary disk is rotated in a reverse direction.

Thus, when the rotary disk is reversely rotated, it is possible to reduce coins that are held-up between the stationary member and the rotary disk by virtue of the return guide. Accordingly, it is possible to more smoothly resume a normal coin sorting operation when the rotary disk is rotated forwardly again.

DESCRIPTION OF THE PREFERRED EMBODIMENTS

Preferred embodiments of the present invention will be described with reference to FIGS. 1 to 11 of the accompanying drawings.

[General Construction]

Figure 1:
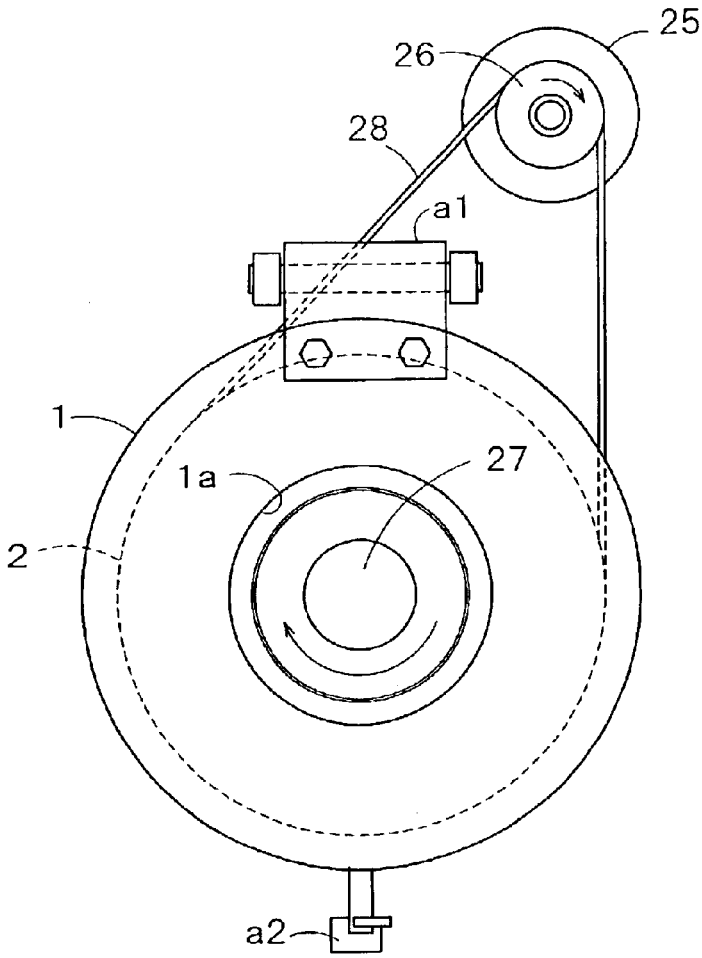
FIG. 1 is a plan view of a coin sorting apparatus in a preferred embodiment according to the present invention.
Figure 2:
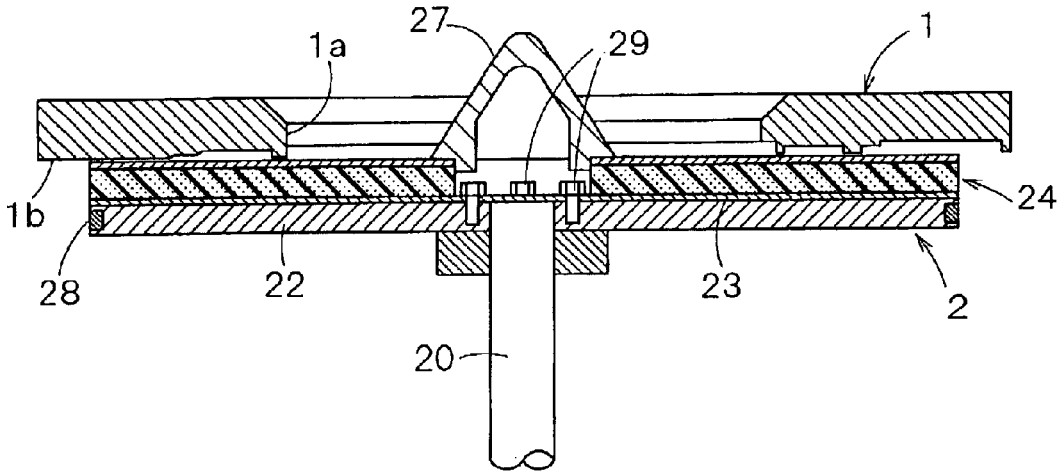
FIG. 2 is a longitudinal sectional view of disks of the coin sorting apparatus shown in FIG. 1.

Referring to FIGS. 1 and 2, a coin sorting apparatus of a preferred embodiment comprises a stationary disk (stationary member) 1 and a rotary disk 2 disposed under the stationary disk 1 contiguously with a lower surface thereof. The stationary disk 1 and the rotary disk 2 are joined by a hinge *a*1 (FIG. 1) so that the stationary disk 1 can be turned about the hinge *a*1 relative to the rotary disk 2. A locking device *a*2 (FIG. 1) connected to a part diametrically opposite to the hinge *a*1 of the stationary disk 1 locks the stationary disk 1 in place over the rotary disk 2.

An inlet opening (coin-feed opening) 1*a* is formed in a central part of the stationary disk 1. The coin sorting apparatus is formed such that a coin fed through the inlet opening 1*a* of the stationary disk 1 slides along lower surface 1*b* (FIG. 2) of the stationary disk 1 as the rotary disk 2 rotates. A guide structure (described later) is formed in the stationary disk 1 for selectively guiding coins sliding along the lower surface 1*b* of the stationary disk 1, according to diameters of the coins.

[Construction of Rotary Disk]

Figure 5:
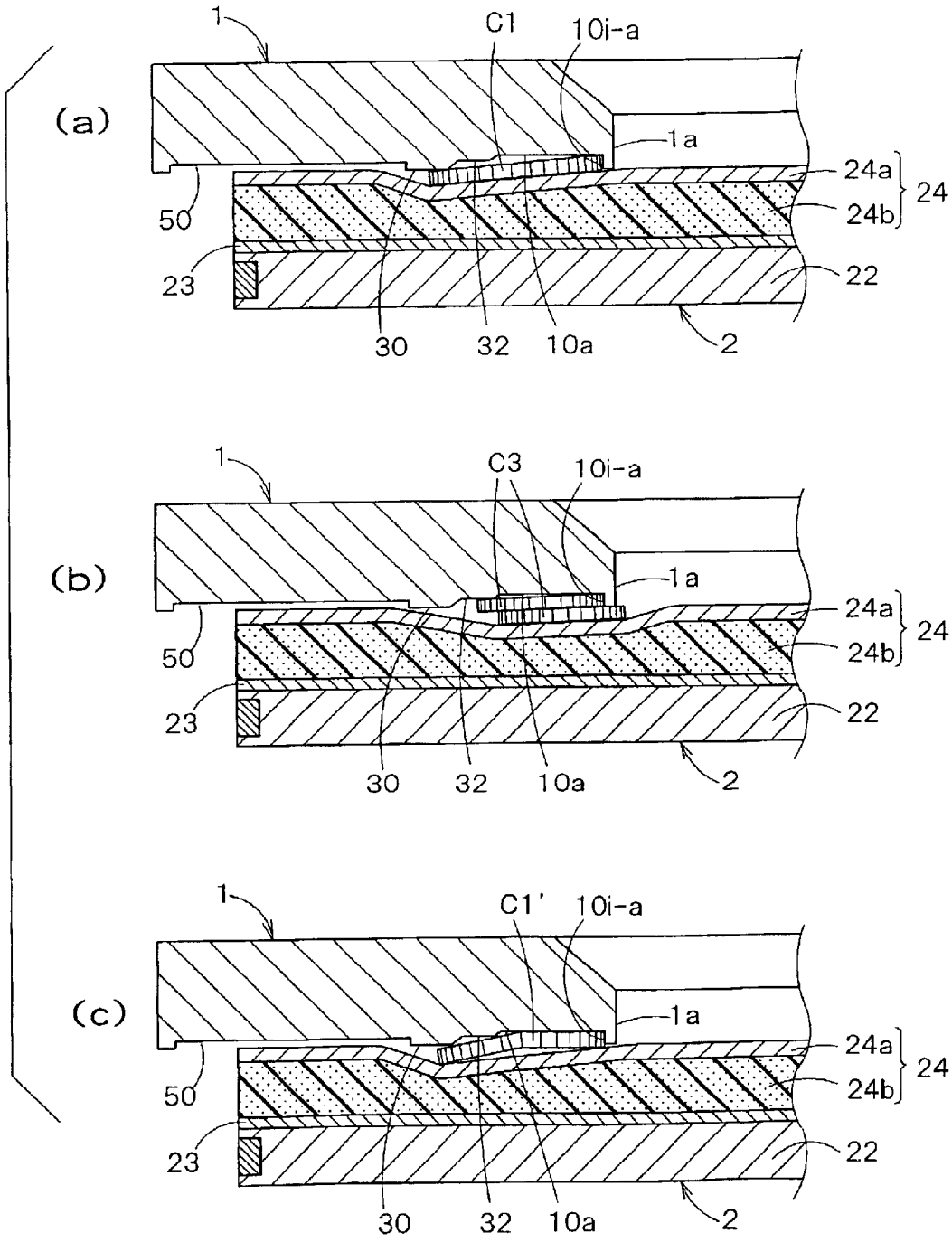
FIGS. 5(*a*)–5(*c*) are sectional views taken along line X—X in FIG. 4, in states where a normal coin, overlapping coins and a deformed coin are moving in a coin passage, respectively.
Figure 5A:
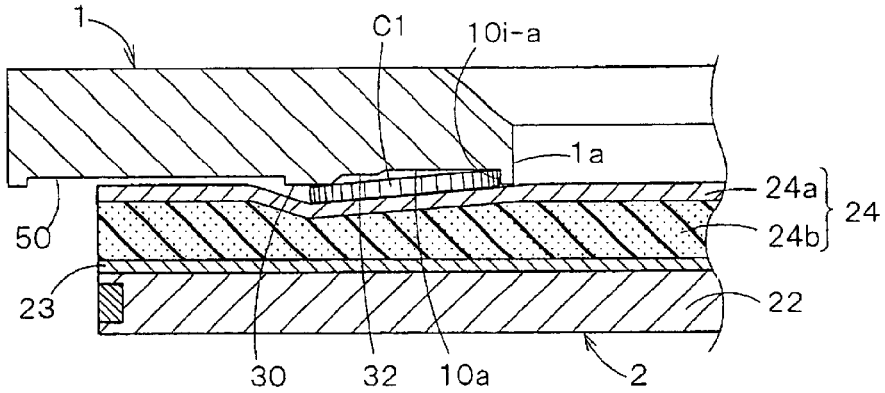
Figure 5B:
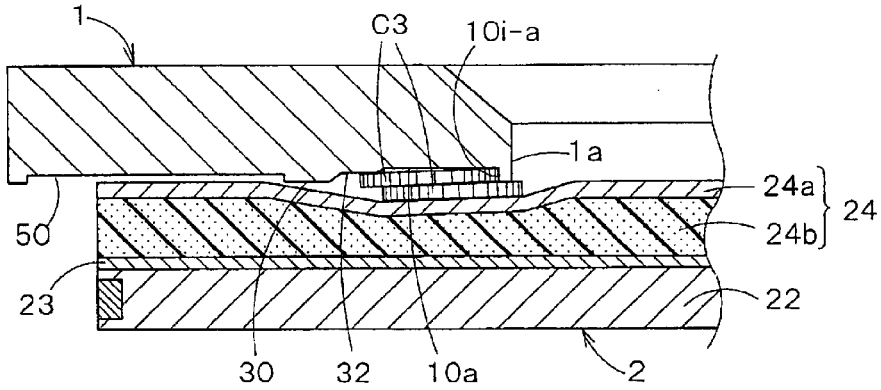
Figure 5C:
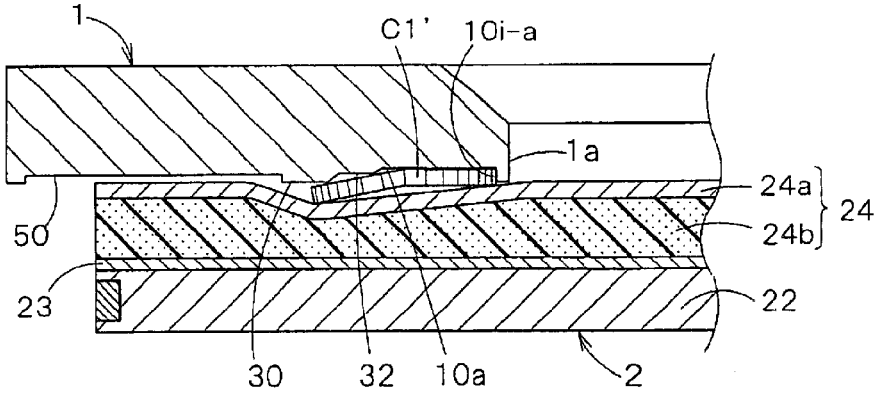

The rotary disk 2 comprises a disk body 22 supported for rotation about a shaft 20, and a disk-shaped resilient member 24 attached to an upper surface of the disk body 22. As shown in FIGS. 5(*a*)–5(*c*), the resilient member 24 has a thin urethane rubber layer 24*a* and a porous resilient layer 24*b* underlying the urethane rubber layer 24*a*. Preferably, the porous resilient layer 24*b* is formed of sponge rubber (foam rubber) having a comparatively high impact resilience. A circular metal plate 23 is attached to a lower surface of the resilient member 24. The metal plate 23 is fastened to the disk body 22 with screws 29 to attach the resilient member 24 detachably to the disk body 22.

The resilient member 24 attached to the disk body 22 holds coins together with the stationary disk 1 and moves the coins as the rotary disk 2 rotates. In addition, the resilient member 24 absorbs a variation of thickness of a gap between the resilient member 24 and the stationary disk 1, and differences in thickness between coins of different denominations (FIGS. 5(*a*)–5(*c*), 7 and 8).

As shown in FIG. 1, the rotary disk 2 is driven for rotation by a motor 25 through a pulley 26, attached to an output shaft of the motor 25, and a drive belt 28 extended between the pulley 26 and the disk body 22 (FIGS. 5(*a*)–5(*c*)) of the rotary disk 2. A conical member 27 is disposed on a central part of the rotary disk 2 to prevent coins from remaining on the central part of the rotary disk 2. [Construction of Stationary Disk]

Figure 6:
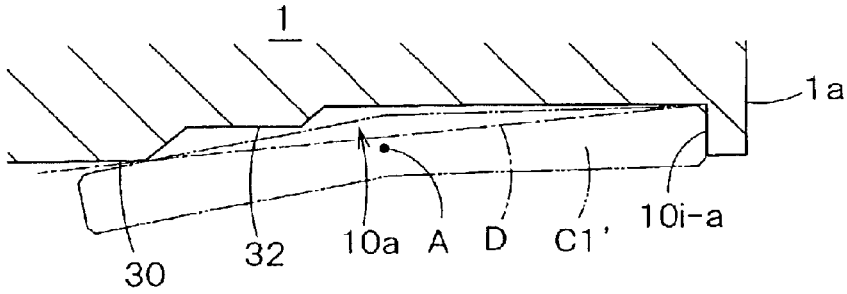
FIG. 6 is an enlarged sectional view of a large-coin passage section corresponding to a part of FIG. 5(*c*)
Figure 7:
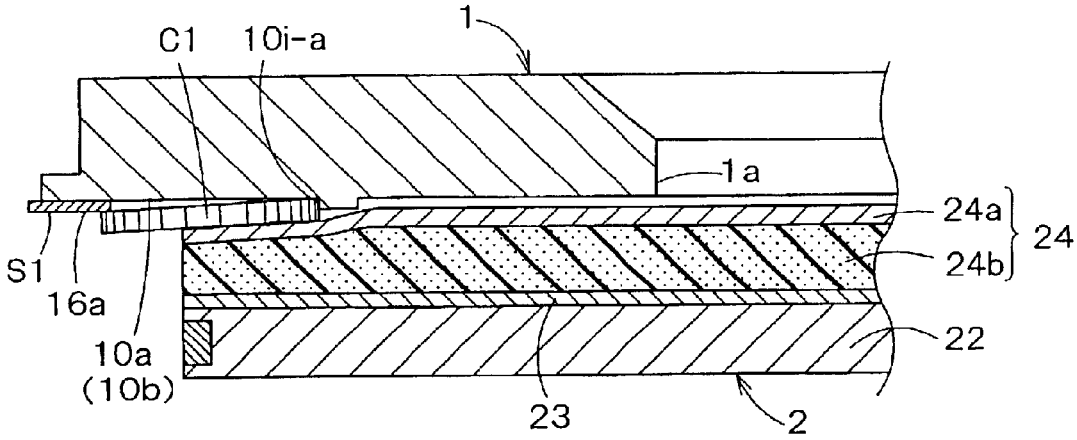
FIG. 7 is a sectional view taken along line Y—Y in FIG. 4, in a state where a normal coin is moving in the coin passage.

A specific construction of the stationary disk 1, especially a guide structure formed on the lower surface 1*b* thereof, will be described with reference to FIGS. 3 to 11. In the following description, reference symbols C1, C2 and C3 denote normal (flat) coins. On the other hand, reference symbols C1', C2' and C3' denote deformed coins bent such that a convex side thereof faces the lower surface 1*b* of the stationary disk 1, especially deformed coins fed into a coin passage 10 (described later) with bending axes A (FIG. 6) thereof in a substantially tangential direction with respect to the coin passage 10 as shown in FIG. 6. The bending axis A of each deformed coin C1', C2' or C3' extends in a substantially diametral direction thereof.

Figure 3:
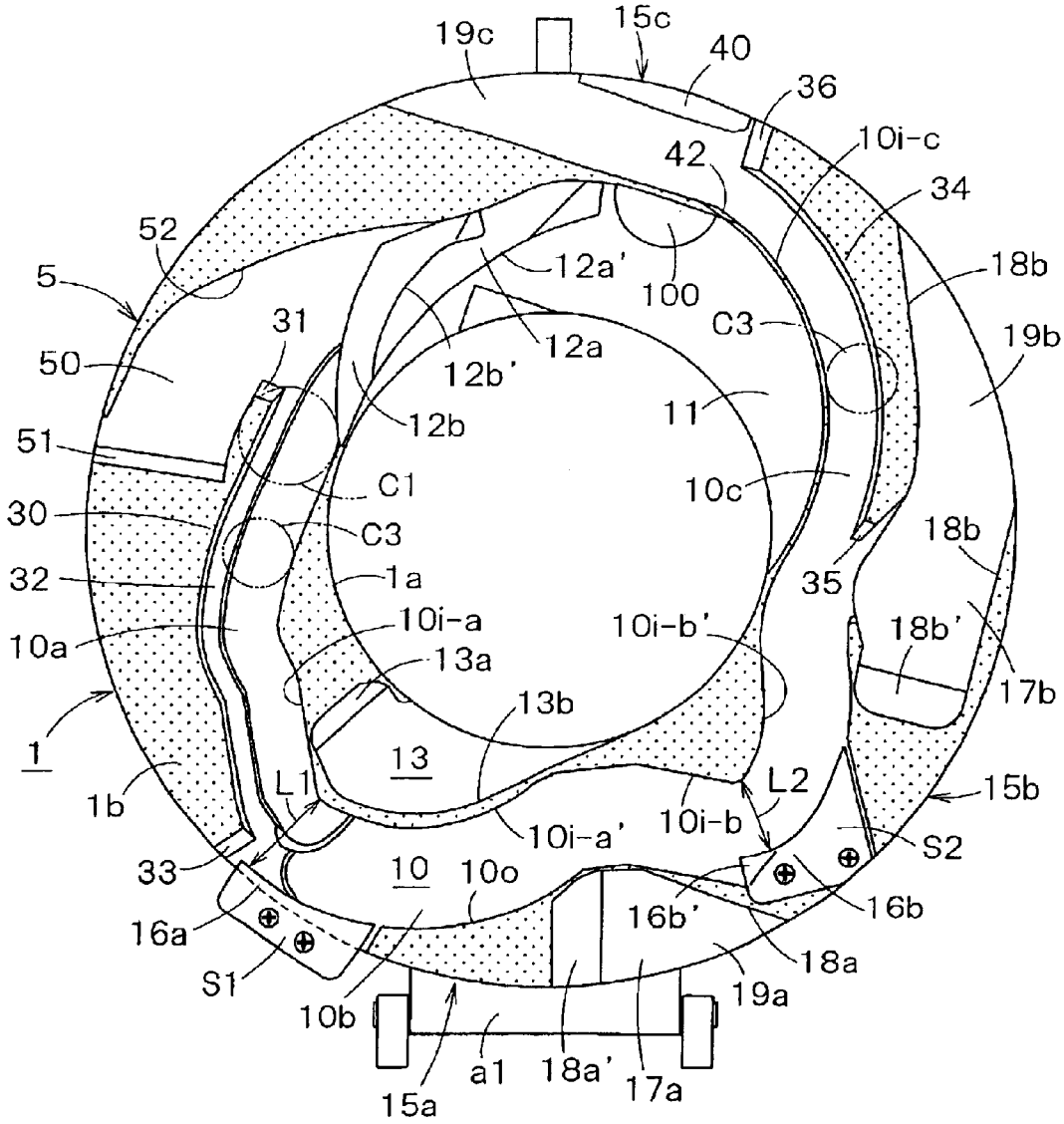
FIG. 3 is a bottom view of a stationary disk of the coin sorting apparatus shown in FIG. 1.

As shown in FIG. 3, the guide structure comprises a coin passage 10 formed concavely in the lower surface 1*b* of the stationary disk 1. The coin passage 10 extends counterclockwise as viewed in FIG. 3 in a meandering spiral from the inlet opening 1*a* toward a periphery of the stationary disk 1. The coin passage 10 has, arranged from the inlet opening 1*a* toward the periphery of the stationary disk 1, a large-coin passage section 10*a*, a medium-coin passage section 10*b* and a small-coin passage section 10*c*. The large-coin passage section 10*a* is configured to permit passage of large, medium and small coins C1, C2 and C3. The medium-coin passage section 10*b* has a width L1 that permits passage of only medium and small coins C2 and C3. The small-coin passage section 10*c* has a width L2 that permits passage of only small coins C3 in an upstream section thereof.

The large-coin passage section 10*a* has a coin entrance 11 facing the inlet opening 1*a*, and stairs 12*a* and 12*b* formed at an interval on a downstream side with respect to the coin entrance 11. The coin entrance 11 is formed such that a thickness of a gap between the coin entrance 11 and the resilient member 24 of the rotary disk 2 (FIG. 2) is greater than that of thickest coins. Thus, all coins fed into the inlet opening 1*a* can be moved into the coin entrance 11 by centrifugal force as the rotary disk 2 rotates.

There is a possibility that a pair of overlapping coins are moved into the coin entrance 11. These overlapping coins include an "upper coin" that is contiguous with the stationary disk 1 and a "lower coin" that is contiguous with the rotary disk 2 (see FIG. 5(*b*)). Thus, the coin entrance 11 is provided with a semicircular protrusion 100 in a radially outer side thereof. The protrusion 100 pushes the "upper coin" back toward the inlet opening 1*a*.

The stairs 12*a* and 12*b* are formed to reduce a thickness of the gap between the resilient member 24 of the rotary disk 2 (FIG. 2) and the large-coin passage section 10*a* stepwise toward a downstream side thereof. By virtue of the stairs 12*a* and 12*b*, overlapping coins are separated from each other to ensure that coins do not overlap each other and move in a single file in the coin passage 10. FIG. 5(*a*) shows a state where large coins C1 are moving in a single file in the large-coin passage section 10*a*.

As shown in FIG. 3, a coin returning part 13 is formed contiguously with the inlet opening 1*a* in a region corresponding to a boundary between the large-coin passage section 10*a* and the medium-coin passage section 10*b*. The coin returning part 13 deals with overlapping coins passed by stairs 12*a* and 12*b* without being separated. An upstream and a downstream side of the coin returning part 13 are limited by a sloped step portion 13*a* and a vertical guiding step portion 13*b*, respectively.

Figure 4:
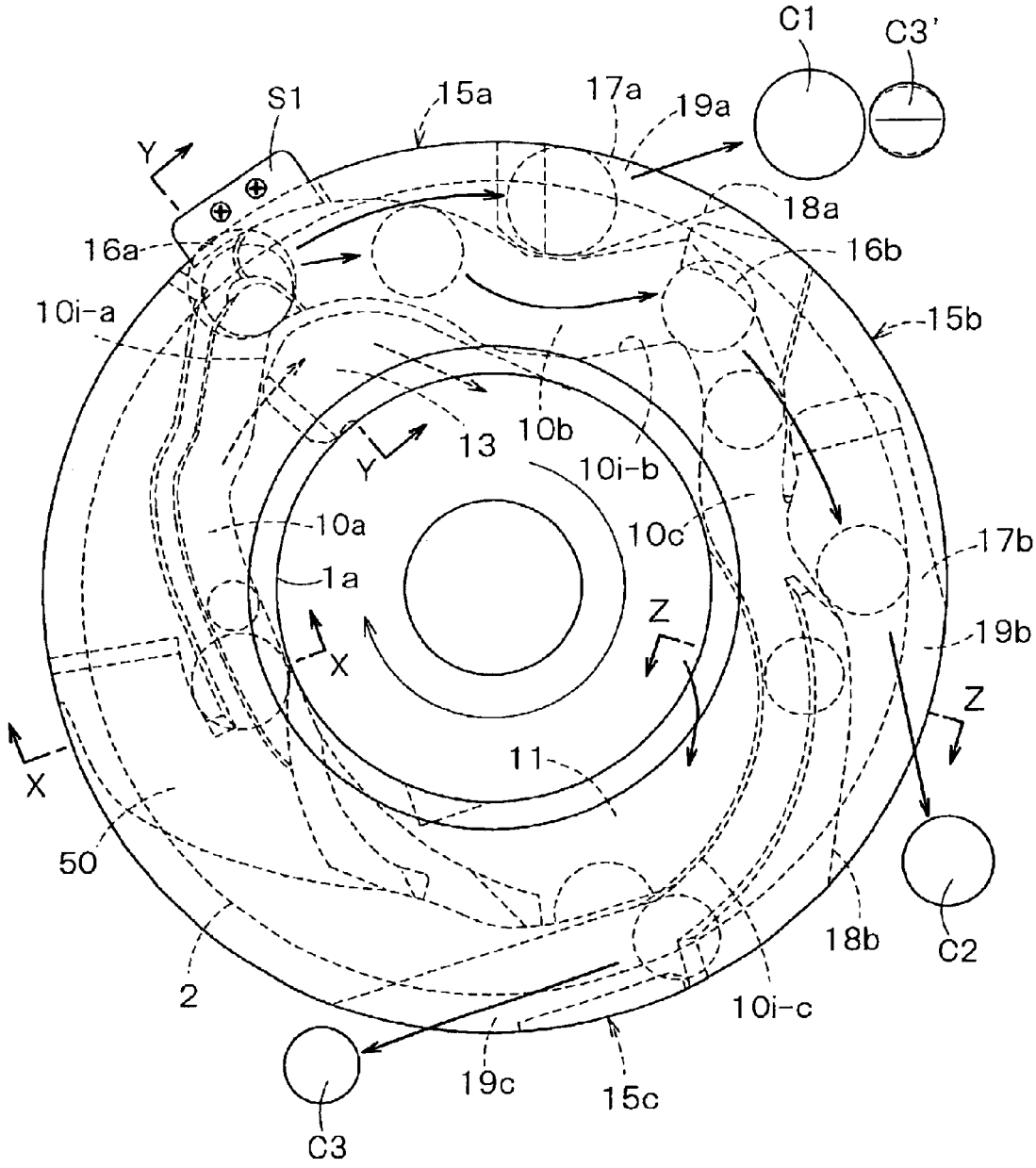
FIG. 4 is a plan view of the disks for explaining movement of coins in the coin sorting apparatus shown in FIG. 1.

Since the large-coin passage section 10*a* extends spirally away from a center toward a circumference of the stationary disk 1, it is intended that outer edges of all coins moving therein should engage a radial inner edge portion 10*i-a* thereof (see FIG. 4). The radial inner edge portion 10*i-a* defines a shoulder formed of a height smaller than a thickness of a thinnest coin so as not to prevent the "lower coin" from returning toward the inlet opening 1*a* (see FIGS. 5(*a*)–5(*c*)). The coin returning part 13 is configured to receive the "lower coin" passing over the radial inner edge portion 10*i-a* through the step portion 13*a* and return this same coin toward the inlet opening 1*a* by virtue of the guiding step portion 13*b*.

As shown in FIGS. 3, 5(*a*)–5(*c*) and 6, the large-coin passage section 10*a* has, at least in a section corresponding to the radial inner edge portion 10*i-a*, a recessed-profile configured to accommodate convex sides of the deformed coins C1', C2' and C3' to ensure an engagement of outer edges of the deformed coins with the radial inner edge portion 10*i-a*. FIG. 6 shows that the large-coin passage section 10*a* is recessed more deeply than an imaginary reference plane D for normal coins so as to have the recessed-profile.

The recessed-profile of the large-coin passage section 10*a* includes a stepped-profile configured to prop a peripheral part of each of the coins to be guided, on a radially outer side of the passage section 10*a*. The stepped-profile of the passage section 10*a* includes an outer circumferential step 30 for the large coins and an outer circumferential step 32 for the medium and small coins to form a two-stepped-profile corresponding to two ranges of diameters of the coins. Stepped portions 31 and 33 (FIG. 3) are formed at an upstream end and a downstream end of the outer circumferential step 30, respectively. The stepped portions 31 and 33 have sloped configurations for allowing the coins to pass easily.

Referring to FIGS. 3 and 4, a large-coin sorting guide 15*a* is disposed radially outside the medium-coin passage section 10*b* to guide only the large coins C1 selectively and to eject the large coins C1 in a substantially tangential direction. The large-coin sorting guide 15*a* has a step 16*a* and an ejecting passage 17*a*. The step 16*a* is formed at a boundary between the large-coin passage section 10*a* and the medium-coin passage section 10*b*. The step 16*a* is formed such that only a peripheral part of each of the large coins C1 (including the deformed coins C1') of diameters greater than the width L1 of the medium-coin passage section 10*b* runs onto the step 16*a* (see FIGS. 4 and 7).

The ejecting passage 17*a* has a guide edge 18*a* for guiding a coin that has run onto the step 16*a* for movement in a substantially tangential direction, and an outlet 19*a* through which the coin guided by the guide edge 18*a* is ejected to an exterior. The sorting guide 15*a* further has a stepped portion 18*a'* formed transversely of a coin-passing direction between the step 16*a* and the ejecting passage 17*a*. The stepped portion 18*a'* has a sloped configuration for allowing the coins to pass easily.

Since all the coins engage the radial inner edge portion 10*i-a*, the medium coins C2 and the small coins C3, respectively, having diameters smaller than the width L1, do not run onto the step 16*a* and move into the medium-coin passage section 10*b*.

On the other hand, it is difficult for an outer edge of each of the medium and small deformed coins C2' and C3' to engage a radial outer edge 10*o* of the coin passage 10 between the step 16*a* and the ejecting passage 17*a*. Accordingly, there is a strong possibility that the deformed coins C2' and C3' pass over the edge 10*o* to enter the ejecting passage 17*a*. Thus, almost all the deformed coins C2' and C3' are ejects to the exterior from the outlet 19*a* of the ejecting passage 17*a*, in the same way as the large deformed coin C1'.

A medium-coin sorting guide 15*b* is disposed radially outside the small-coin passage section 10*c* to guide only the medium coins C2 selectively, and to eject the medium coins C2 in a substantially tangential direction. The medium-coin sorting guide 15*b*, similarly to the large-coin sorting guide 15*a*, has a step 16*b* and an ejecting passage 17*b*.

The step 16*b* is formed at a boundary between the medium-coin passage section 10*b* and the small-coin passage section 10*c*. The step 16*b* is formed such that only a peripheral part of each of the medium coins C2 of diameters greater than the width L2 of the small-coin passage section 10*c* runs onto the step 16*b*. A ramp 16*b'* (FIG. 3) is formed on an upstream side of the step 16*b* to facilitate coins running onto the step 16*b*.

The ejecting passage 17*b*, similarly to the ejecting passage 17*a* of the large-coin sorting guide 15*a*, has a guide edge 18*b* and an outlet 19*b*. The sorting guide 15*b* further has a stepped portion 18*a'*, formed transversely of a coin-passing direction, between the step 16*b* and the ejecting passage 17*b*. The stepped portion 18*b'* also has a sloped configuration for allowing the coins to pass easily.

Since a downstream part of the medium-coin passage section 10*b* extends away from the center toward the outer circumference of the stationary disk 1, it is intended that outer edges of all the coins moving therein should engage a radial inner edge portion 10*i-b* thereof (see FIG. 4). Thus, small coins C3 of a diameter smaller than the width L2 move into the small-coin passage section 10*c* without running onto the step 16*b*.

The small-coin passage section 10*c* extends downstream toward an inner circumference and then toward the outer circumference of the stationary disk 1, and terminates in a small-coin sorting guide 15*c* having an outlet 19*c*. The small-coin sorting guide 15*c* is configured to guide only the small coins C3 selectively, and to eject the small coins C3 in a substantially tangential direction. Since a downstream part of the small-coin passage section 10*c* also extends away from the center toward the outer circumference of the stationary disk 1, it is intended that outer edges of all the coins moving therein should engage a radial inner edge portion 10*i-c* thereof (see FIG. 4). The radial inner edge portion 10*i-c* also defines a shoulder formed of a height smaller than a thickness of the thinnest coin so as not to prevent the "lower coin" from returning toward the inlet opening 1*a* (coin entrance 11).

As described above, almost all the deformed coins C2' and C3' are ejected to the exterior from the outlet 19*a* for the large coins. There is a possibility that some of the deformed coins C2' and C3' pass though the medium-coin passage section 10*b* and enter the small-coin passage section 10*c*.

Figure 8:
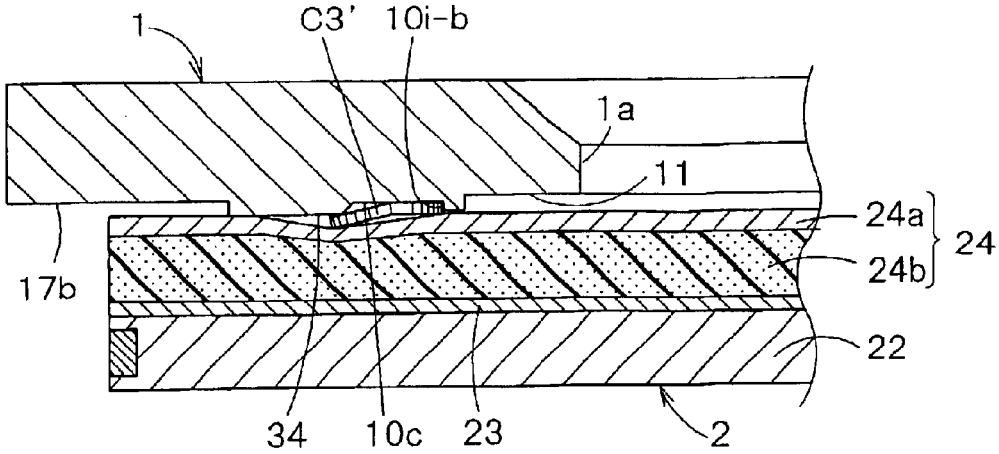
FIG. 8 is a sectional view taken on line Z—Z in FIG. 4, in a state where a deformed coin is moving in the coin passage.

Thus, as shown in FIGS. 3 and 8, the small-coin passage section 10*c* also has, at least in a section corresponding to the inner edge portion 10*i-c,* a recessed-profile configured to accommodate the convex sides of the deformed coins C2' and C3' to ensure an engagement of outer edges of the deformed coins with the radial inner edge portion 10*i-c*. The recessed-profile of the small-coin passage section 10*c* includes a stepped-profile configured to prop a peripheral part of each of the coins to be guided, on a radial outer side of the passage section 10*c*. The stepped-profile of the passage section 10*c* includes an outer circumferential step 34 for the medium and small coins. Stepped portions 35 and 36 (FIG. 3) are formed at an upstream end and a downstream end of the outer circumferential step 34, respectively. The stepped portions 31, 33 have sloped configurations for allowing the coins to pass easily.

Figure 9:
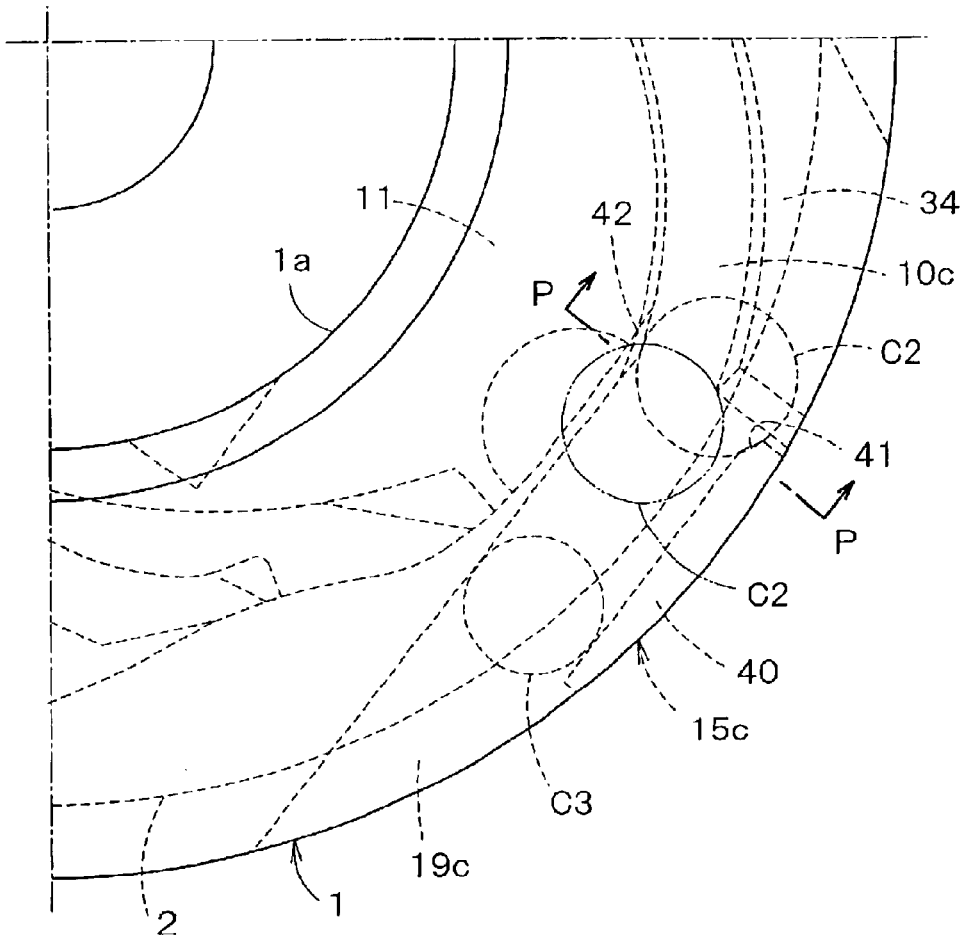
FIG. 9 is an enlarged view of a part of FIG. 4 corresponding to a section including a small-coin sorting guide.
Figure 10:
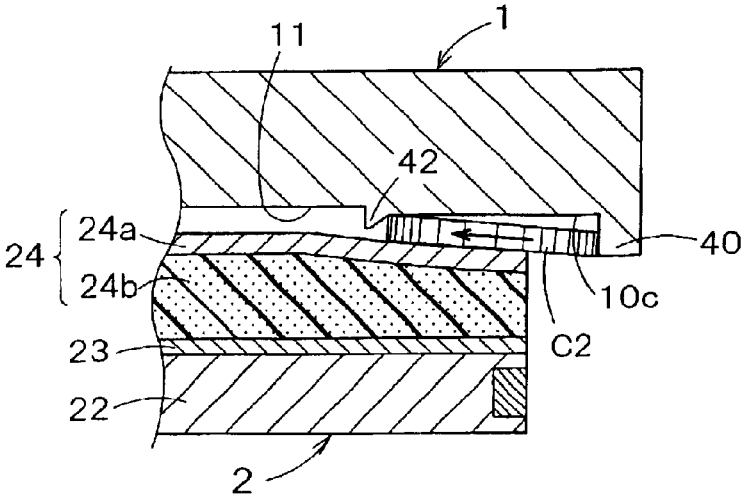
FIG. 10 is a sectional view taken along line P—P in FIG. 9.

Referring to FIGS. 3, 9 and 10, in a downstream part of the small-coin passage section 10*c,* a protrusion 40 is formed on a radially outer side thereof before the outlet 19*c*. The protrusion 40 has a bevel 41 for returning the medium coins. A slope portion 42 is formed in a side of the small-coin passage section 10*c* opposite the bevel 41 of the protrusion 40.

Even if the medium coin C2 (including the deformed medium coin C2') enters the small-coin passage section 10*c* for some reason, it is possible to return the medium coin C2 toward the inlet opening 1*a* (coin entrance 11) by virtue of the bevel 41 of the protrusion 40 and the slope portion 42. That is to say, the medium coin C2 is pushed by the bevel 41 toward a radially inner side of the passage section 10*c* so that the medium coin C2 runs onto the slope portion 42. Then, the medium coin C2 is returned toward the inlet opening 1*a* while passing over the radially inner side of the passage section 10*c,* as the rotary disk 2 rotates forwardly, i.e. in a normal direction.

Figure 11:
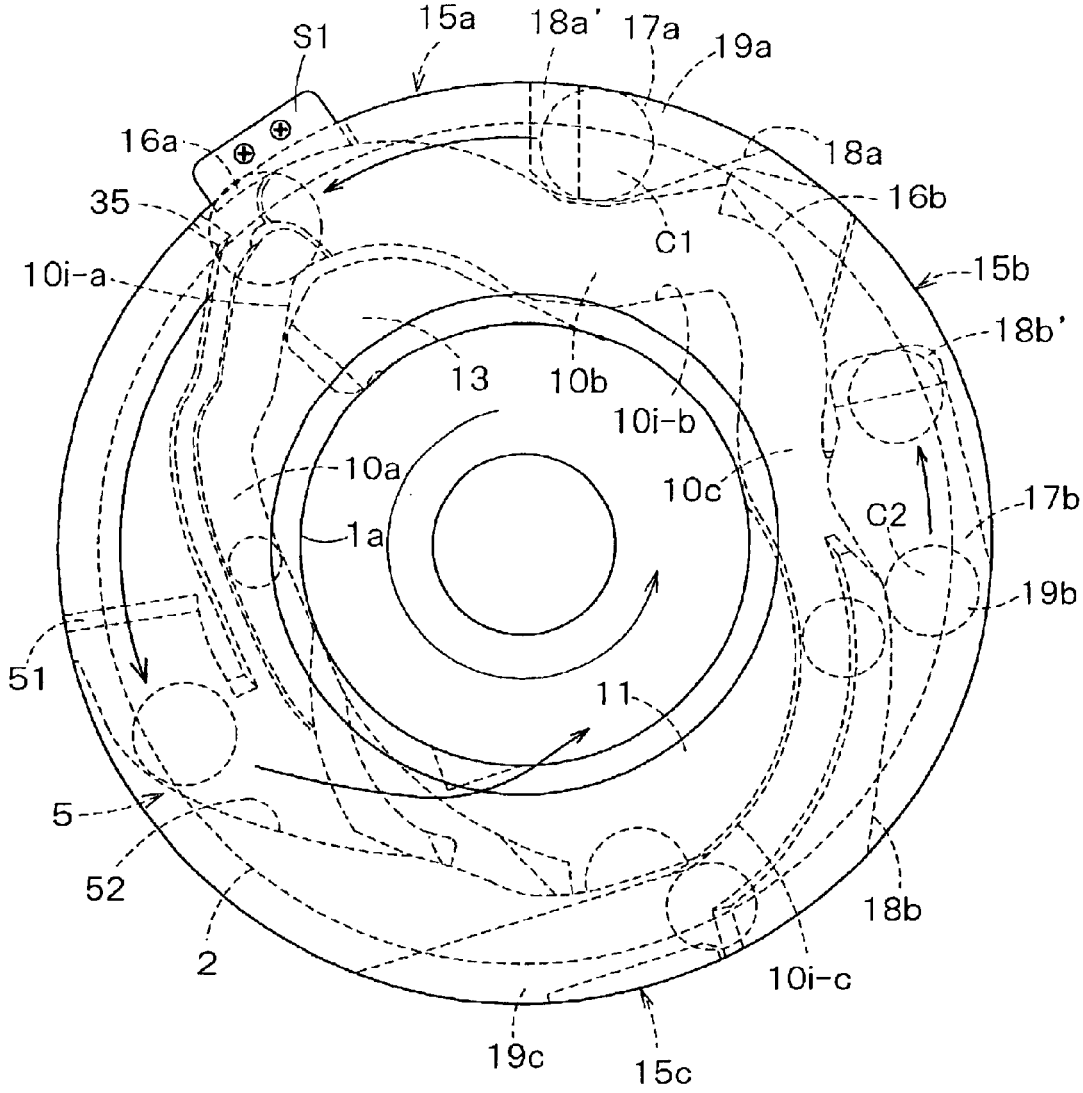
FIG. 11 is a view similar to FIG. 4, showing a state where a rotary disk is reversely rotated.

Referring to FIGS. 3 and 11, in a upstream part of the large-coin passage section 10*a* (when rotary disk 2 rotate forwardly), a return guide 5, having a return passage 50 and a guiding edge 52, is formed on a radially outer side thereof. The return guide 5 is configured to guide coins that have moved to a radially outer side of the stationary disk 1 to return these same coins toward the inlet opening 1*a* (coin entrance 11) when the rotary disk 2 is rotated in a reverse direction, as shown in FIG. 11. A stepped portion 51 is formed at an entrance of return passage 50, i.e. an upstream end of the return passage 50 when the rotary disk 2 is reversely rotated. The stepped portion 51 has a sloped configuration for allowing the coins to pass easily.

As shown in FIG. 3, the coin passage 10 extends downstream from the steps 16*a* and 16*b* to approach the center of the stationary disk 1, respectively. That is to say, two sections of the coin passage 10 downstream from the steps 16*a* and 16*b* have radial inner edge portions 10*i-a'* and 10*i-b'* approaching the center of the stationary disk 1, respectively. Therefore, when the rotary disk 2 is reversely rotated, the radial inner edge portions 10*i-a'* and 10*i-b'* urge coins radially outwardly to ensure engagement of the coins with the radial inner edge portions 10*i-a'* and 10*i-b'*. Thus, even if the return guide 5 fails to return some coins toward the inlet opening 1*a* when the rotary disk 2 is reversely rotated, it is intended that outer edges of those coins should engage the radial inner edge portions 10*i-a* and 10*i-b* opposite the steps 16*a* and 16*b* when the rotary disk 2 is rotated forwardly again.

As sown in FIG. 3, in this preferred embodiment, the steps 16*a* and 16*b* are formed by step plates S1 and S2 fastened to the stationary disk 1 with screws. The step plates S1 and S2 may be horizontally adjustable on the stationary disk 1 with respect to a width of the coin passage 10. In this case, the widths L1 and L2 of the coin passage 10 corresponding to the steps 16*a* and 16*b* are adjusted so that the widths L1 and L2 conform to a diameter of coins to be sorted. Reliability and smoothness of a coin sorting process can be enhanced by finely adjusting the widths L1 and L2 of the coin passage 10. The step plates S1 and S2 may be formed of an abrasion-resistant material separately from the stationary disk 1, and may be subjected to a hardening process.

[Functions and Effects]

Functions and effects of this embodiment thus constructed will be described. Some of the functions and effects will be omitted or simplified, if those functions and effects are apparent from the foregoing descriptions.

According to this embodiment, it is possible to ensure engagement of an outer edge of the deformed coins C1', C2' and C3' with the radial inner edge portions 10*i-a* and 10*i-c* of the passage sections 10*a* and 10*c* each having a recessed-profile. Accordingly, even if coins to be sorted include the deformed coins C1', C2' and C3', it is possible to always perform a normal coin sorting operation.

In addition, the stepped-profile of the passage section 10*a* includes two outer circumferential steps 30 and 32 corresponding to two ranges of diameters of the coins, i.e. the large coins, and the medium and small coins. Thus, it is possible to form the recessed-profile of the passage section 10*a* having an optimum configuration for each of the ranges of the diameters of the coins.

In this embodiment, almost all the deformed coins C1', C2' and C3' are ejected to the exterior from the outlet 19*a* for large coins. Thus, it is possible to sort the deformed coins C1', C2' and C3' from the medium and small normal coins C2 and C3. Accordingly, it is advantageous that the large coins C1 are treated as reject coins, because the deformed coins C1', C2' and C3' can be treated as the reject coins together with the large coins C1.

By the way, there is a possibility that few medium and small deformed coins C2' and C3' are sorted out together with the medium and small normal coins C2 and C3, respectively. There is also a possibility that the medium and small deformed coins C2' and C3' happen to be fed into the coin passage 10 with their bending axes in a substantially radial direction with respect to the coin passage 10. In addition, there may be some medium and small coins bent such that convex sides thereof face the upper surface of the rotary disk 2, as opposed to the deformed coins C2' and C3'. There is a strong possibility that those medium and small coins are sorted out together with the medium and small normal coins C2 and C3, respectively. Thus, those coins may be separately rejected by using an optical discriminator and the like, after they are sorted by the sorting apparatus of this embodiment, e.g. before sorted coins are re-sorted by denominations.

The stepped portions 18*a'* and 18*b'* (FIG. 3) between the steps 16*a* and 16*b* and the ejecting passages 17*a* and 17*b* have sloped configurations for allowing coins to pass easily, respectively. Thus, it is possible to allow coins that have passed into the ejecting passages 17*a* and 17*b* through the stepped portions 18*a'* and 18*b'* to smoothly return to a side opposite the ejection passages 17*a* and 17*b* when the rotary disk 2 is reversely rotated. In the passage sections 10*a* and 10*c,* the stepped portions 33 and 36 (FIG. 3) of the outer circumferential steps 30 and 34 also have sloped configurations for allowing coins to pass easily, respectively. Accordingly, it is possible to resume a normal coin sorting operation when the rotary disk 2 is rotated forwardly again. In addition, it is possible to ensure a reliability of a batch stopping operation, i.e. an operation in which a coin sorting operation is suspended and resumed by stopping the rotary disk 2 and rotating the rotary disk 2 forwardly as occasion demands.

Furthermore, when the rotary disk 2 is reversely rotated, it is possible to reduce an amount of coins that are held-up between the stationary disk 1 and the rotary disk 2 by virtue of the return guide 5. Accordingly, it is possible to more smoothly resume a normal coin sorting operation when the rotary disk 2 is rotated forwardly again. [Modifications]

Some modifications of this embodiment will be described.

In the present invention, the recessed-profile of the coin passage is not limited to that described above. The recessed-profile may be any kind of profile configured to accommodate a convex side of a deformed coin to ensure engagement of an outer edge of the deformed coin with the radial inner edge portions.

Figure 12A:
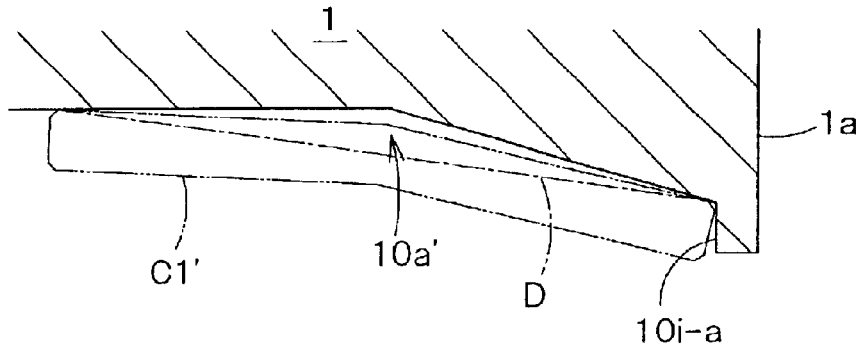
FIG. 12A is a sectional view showing a modification of the large-coin passage shown in FIG. 6.
Figure 12B:
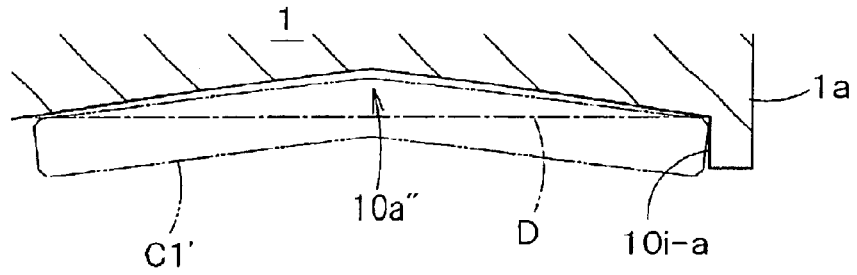
FIG. 12B is a sectional view showing another modification of the large-coin passage shown in FIG. 6.
Figure 13:
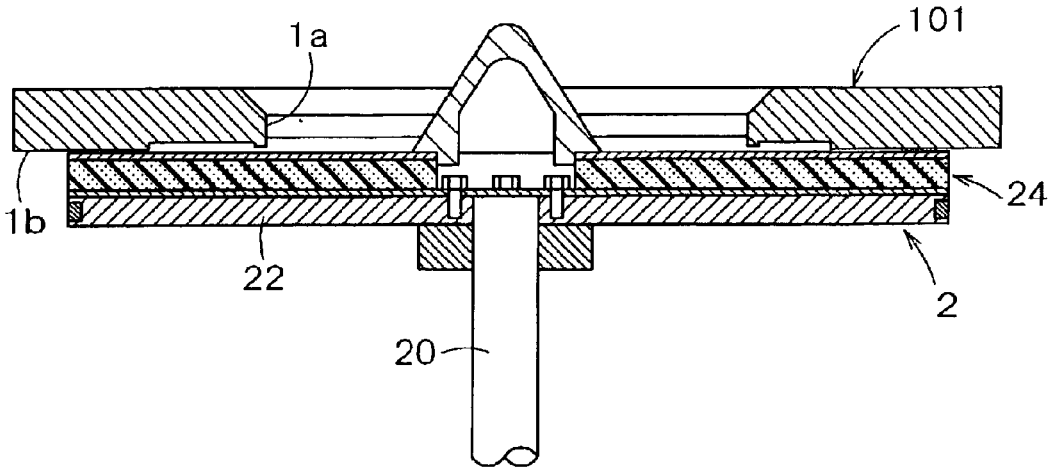
FIG. 13 is a longitudinal sectional view of a coin sorting apparatus of a related art.
Figure 14:
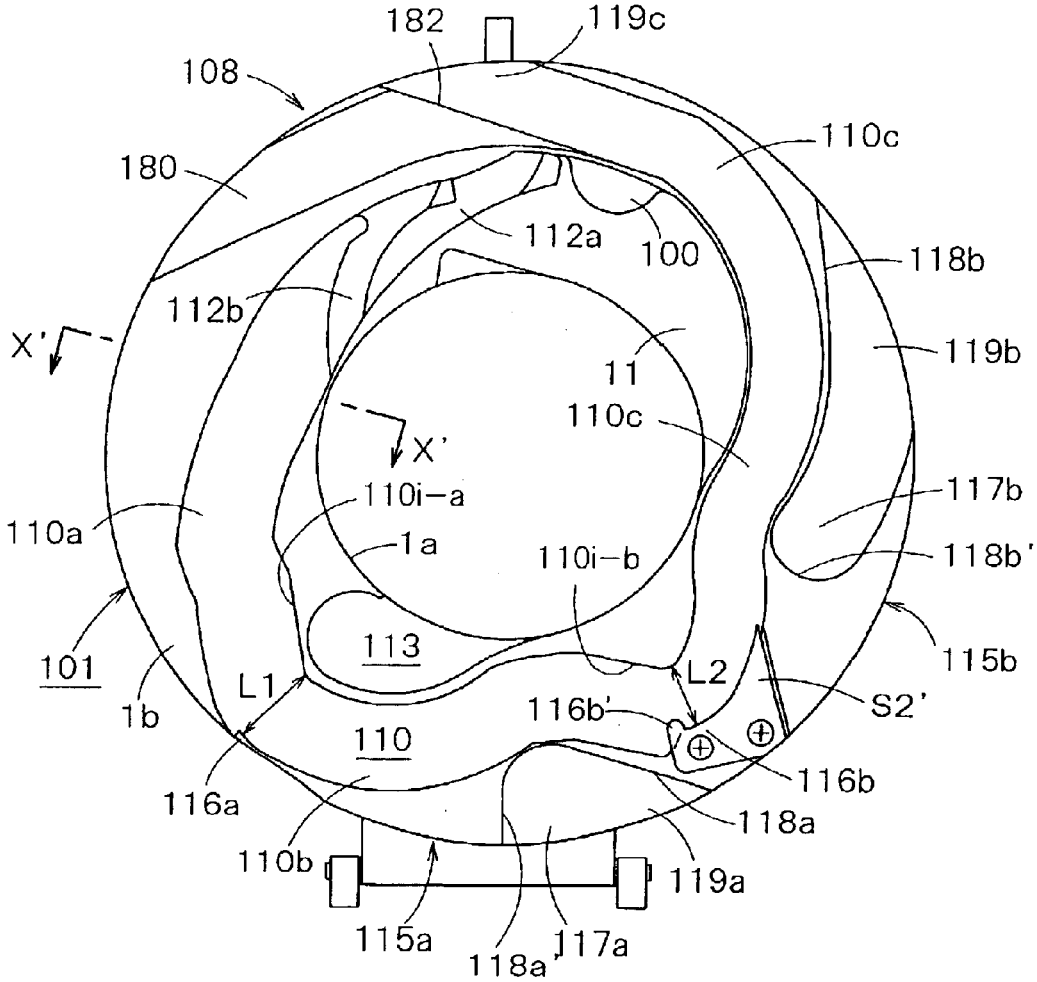
FIG. 14 is a bottom view of a stationary disk of the coin sorting apparatus shown in FIG. 13.
Figure 15:
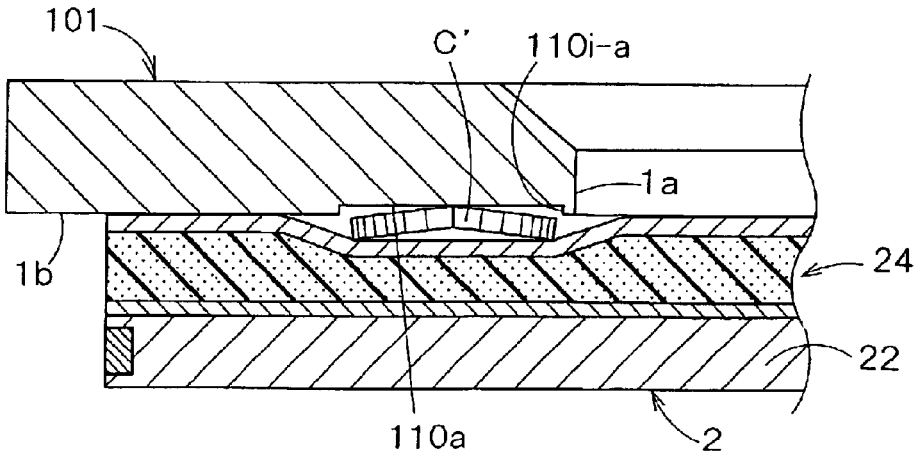
FIG. 15 is a sectional view of disks of the coin sorting apparatus shown in FIG. 13, corresponding to a section taken along line X'—X' in FIG. 14, in a state where a deformed coin is moving in a coin passage.

For example, in place of the recessed-profile of the large-coin passage section 10*a* shown in FIG. 6, modified recessed-profiles are shown in FIGS. 12A and 12B. In the passage section 10*a* shown in FIG. 6, imaginary reference plane D for normal coins inclines downwardly from a radially inner side toward an outer side of the passage section 10*a* (the example of the reference plane D for the large normal coin C1 is shown in FIG. 6). On the other hand, FIG. 12A shows a passage section 10*a′* in which reference plane D inclines oppositely, i.e. upwardly from a radially inner side toward an outer side thereof. FIG. 12B shows a passage section 10*a″* in which reference plane D is substantially horizontal. Incidentally, for clearer comparison of these profiles, each of the passage sections 10*a′* and 10*a″* (FIGS. 12A and 12B) has a more simple recessed-profile than the stepped-profile shown in FIG. 6. That is to say, each of the recessed-profiles of the passage sections 10*a′* and 10*a″* is a simple profile merely corresponding to the convex side of the deformed coin C1'.

What is claimed is:

1. A coin sorting apparatus comprising:

a stationary member provided with a central coin-feed opening; and a rotary disk supported for rotation and disposed under said stationary member contiguously with a lower surface of said stationary member, such that coins fed into said central coin-feed opening of said stationary member slide along said lower surface of said stationary member as said rotary disk rotates, wherein said stationary member includes a guide structure for selectively guiding coins sliding along said lower surface thereof; according to diameters of the coins, said guide structure having (i) a coin passage formed in said lower surface of said stationary member and having a radial inner edge portion configured to engage outer edges of all the coins to be guided, said radial inner edge portion defining a shoulder having a height less than a thickness of a thinnest coin, and (ii) a coin-sorting guide disposed radially outside said coin passage, said coin-sorting guide having (a) a step formed such that, upon rotation of said rotary disk, a peripheral part of each of coins having diameters greater than a reference diameter run up onto said step with an outer edge of this coin engaging said radial inner edge portion of said coin passage, and (b) an ejecting passage for guiding each coin that has run up onto said step and ejecting this coin to an exterior of said stationary member, wherein said coin passage has, at least in a section corresponding to said radial inner edge portion thereof, a recessed-profile configured to accommodate a convex side of a deformed coin, when the deformed coin is received within said coin passage with the convex side thereof facing said stationary member, so as to ensure engagement of an outer edge of the deformed coin with said radial inner edge portion.

2. The coin sorting apparatus according to claim 1, wherein said recessed-profile of said coin passage includes a stepped-profile configured to prop a peripheral part of each of the coins to be guided, on a radially outer side of said coin passage.

3. The coin sorting apparatus according to claim 2, wherein said stepped-profile includes a plurality of steps corresponding to a plurality of ranges of the diameters of the coins.

4. The coin sorting apparatus according to claim 1, wherein said coin-sorting guide further has a stepped portion positioned transversely of a coin-passing direction between said step and said ejecting passage, with said stepped portion having a sloped configuration.

5. The coin sorting apparatus according to claim 4, wherein said stationary member further includes a return guide configured to guide coins to return these coins toward said central coin-feed opening when said rotary disk is rotated in a reverse direction.

6. The coin sorting apparatus according to claim 5, wherein said recessed-profile of said coin passage includes a stepped-profile configured to prop a peripheral part of each of the coins to be guided, on a radially outer side of said coin passage.

7. The coin sorting apparatus according to claim 6, wherein said stepped-profile includes a plurality of steps corresponding to a plurality of ranges of the diameters of the coins.

8. The coin sorting apparatus according to claim 4, wherein said recessed-profile of said coin passage includes a stepped-profile configured to prop a peripheral part of each of the coins to be guided, on a radially outer side of said coin passage.

9. The coin sorting apparatus according to claim 8, wherein said stepped-profile includes a plurality of steps corresponding to a plurality of ranges of the diameters of the coins.

10. The coin sorting apparatus according to claim 2, wherein said stationary member further includes a return guide configured to guide coins to return these coins toward said central coin-feed opening when said rotary disk is rotated in a reverse direction.

11. The coin sorting apparatus according to claim 10, wherein said stepped-profile includes a plurality of steps corresponding to a plurality of ranges of the diameters of the coins.

12. The coin sorting apparatus according to claim 1, wherein said stationary member further includes a return guide configured to guide coins to return these coins toward said central coin-feed opening when said rotary disk is rotated in a reverse direction.

* * * * *